US010304604B2

(12) United States Patent
Lazarus et al.

(10) Patent No.: US 10,304,604 B2
(45) Date of Patent: May 28, 2019

(54) DEFORMABLE INDUCTIVE DEVICES HAVING A MAGNETIC CORE FORMED OF AN ELASTOMER WITH MAGNETIC PARTICLES THEREIN ALONG WITH A DEFORMABLE ELECTRODE

(71) Applicant: U.S. Army Research Laboratory, Washington, DC (US)

(72) Inventors: Nathan S. Lazarus, Bethesda, MD (US); Christopher D. Meyer, Bethesda, MD (US); Iain M. Kierzewski, Silver Spring, MD (US)

(73) Assignee: The United States of America as represented by the Secretary of the Army, Washington, DC ( * ) Notice: Subject to any disclaimer, the term of this patent is extended or adjusted under 35 U.S.C. 154(b) by 376 days.

(21) Appl. No.: 15/144,995

(22) Filed: May 3, 2016

(65) Prior Publication Data

US 2017/0323714 A1 Nov. 9, 2017

(51) Int. Cl.

| | |
|---|---|
| ***H01F 21/02*** | (2006.01) |
| ***H01F 3/08*** | (2006.01) |
| ***H01F 38/14*** | (2006.01) |
| ***H01F 5/00*** | (2006.01) |
| ***H01F 1/26*** | (2006.01) |
| *H01F 27/36* | (2006.01) |

(52) U.S. Cl.

CPC ..... *H01F 3/08* (2013.01); *H01F 1/26* (2013.01); *H01F 5/00* (2013.01); *H01F 38/14* (2013.01); *H01F 27/365* (2013.01)

(58) Field of Classification Search

USPC ..... 336/20, 200, 232

See application file for complete search history.

(56) References Cited

U.S. PATENT DOCUMENTS

| | | | | |
|---|---|---|---|---|
| 4,601,765 | A | 7/1986 | Soileau et al. | |
| 5,104,582 | A * | 4/1992 | Lindsten | F16J 15/43 252/500 |
| 5,198,137 | A | 3/1993 | Rutz et al. | |
| 5,321,060 | A | 6/1994 | Oliver et al. | |
| 5,498,644 | A | 3/1996 | Reo | |

(Continued)

OTHER PUBLICATIONS

Elatomer Materials, Google NPL.*

(Continued)

*Primary Examiner* — Shawki S Ismail
*Assistant Examiner* — Kazi S Hossain
(74) *Attorney, Agent, or Firm* — Eric Brett Compton

(57) ABSTRACT

A deformable inductive device includes a magnetic core formed of an elastomer material having magnetic particles dispersed in it and at least one deformable electrode. Depending on the device's configuration, the deformable element may be embedded in, attached to, or in close proximity with the magnetic core. In some embodiments, the deformable inductive device may be configured as an inductor, solenoid, or transformer and the deformable electrode is at least partially embedded in the magnetic core, for instance. In another embodiment, the deformable inductive device may be configured as part of a wireless power transfer system which includes a coil and a magnetic backplane having the magnetic core with the coil being attached to or in close proximity to the magnetic backplane.

17 Claims, 10 Drawing Sheets

(56) References Cited

U.S. PATENT DOCUMENTS

| | | | | |
|---|---|---|---|---|
| 7,219,416 | B2 | 5/2007 | Inoue et al. | |
| 7,477,123 | B2 | 1/2009 | Beerling | |
| 2007/0115084 | A1* | 5/2007 | Beerling | H01F 17/0006 336/62 |
| 2009/0095380 | A1* | 4/2009 | Sato | H01F 1/14791 148/309 |
| 2010/0001823 | A1* | 1/2010 | Kawarai | H01F 17/0013 336/200 |
| 2010/0253463 | A1* | 10/2010 | Shimomura | H01F 17/04 336/200 |
| 2013/0119511 | A1* | 5/2013 | Shi | H01F 27/2804 257/531 |
| 2014/0035520 | A1* | 2/2014 | Nakayama | H02J 17/00 320/108 |

OTHER PUBLICATIONS

M. Zrinyi, L. Barsi and A. Buki, "Ferrogel: A New Magneto-controlled elastic medium," Polymer Gels and Networks, vol. 5, 1997, pp. 415-427.

S. P. Lacour, S. Wagner, Z. Huang, and Z. Suo, "Stretchable gold conductors on elastomeric substrates," Applied Physics Letters, vol. 82, No. 15, Apr. 2003, 2404-2406.

W. Wang, Z. Yao, J.C. Chen, and J. Fang, "Composite elastic magnetic films with hard magnetic feature," J Micromech. Microeng., vol. 14, 2004, pp. 1321-1327.

D. S. Gray, J. Tien, and C. S. Chen, "High-conductivity elastomeric electronics," Adv. Mater., pp. 393-397 (Feb. 2004).

C. Yamahata, F. Lacharme, and M.A. M. Gijs, "Glass valveless micropump using electromagnetic actuation," Microelectronic Engineering, 2005.

J. Engel, J. Chen, N. Chen, S. Pandya, and C. Liu, "Multi-walled carbon nanotube filled conductive elastomers: Materials and Application to Micro transducers," Proc. MEMS 2006, pp. 246-249.

Z. Varga, G. Filipcsei, and M. Zrinyi, "Magnetic field sensitive functional elastomers with tuneable elastic modulus," Polymer vol. 47, 2006, pp. 227-233.

H. Kim, T. Maleki, P. Wei, and B. Ziaie, "A biaxial stretchable interconnect with liquidalloy-covered joints on elastomeric substrate," J. Microelectromech. Syst., vol. 18, No. 1, Feb. 2009 pp. 138-146.

I. Kong, S. H. Ahmad, M. H. Abdullah, D. Hui, A. N. Yusoff, and D. Puryanti, "Magnetic and microwave absorbing properties of magnetite-thermoplastic natural rubber nanocomposites," J. Magnetism and Magnetic Materials, 322, 2010, 3401-3409.

D. Kim et al., "Epidermal Electronics," Science, vol. 333, Aug. 2011, pp. 838-843.

A. Fassler and C. Majidi, "Soft-matter capacitors and inductors for hyperelastic strain sensing and stretchable electronics," Smart Mater. Struct., vol. 22, 2013, 055023 (8pp).

C. Keplinger, J. Sun, C. C. Foo, P. Rothemund, C. M. Whitesides, and Z. Suo, "Stretchable transparent ionic conductors," Science, vol. 341, Aug. 2013 pp. 984-987.

Lazarus, N.; Meyer, C. D.; Bedair, S. S.; Nochetto, H.; Kierzewski, I. M. "Multilayer Liquid Metal Stretchable Inductors," Smart Mater. Struct. 2014, 23, 085036.

N. Lazarus, C. D. Meyer and S. S. Bedair, "Stretchable Inductor Design," IEEE Transactions on Electron Devices, vol. 62, No. 7, pp. 2270-2277, Jul. 2015.

Nathan Lazarus, Chris D. Meyer, Sarah S. Bedair, Geoffrey A. Slipher, and Iain M. Kierzewski, "Magnetic Elastomers for Stretchable Inductors," ACS Applied Materials & Interfaces 2015, 7 (19), 10080-10084 (published May 6, 2015).

N. Lazarus and C. D. Meyer, "Ferrofluid-based Stretchable Magnetic Core Inductors," Journal of Physics: Conference Series 660 (2015) 012007 (paper presented Dec. 2, 2015 at the PowerMEMS 2015 Conference, Dec. 1-4, 2015, Boston Massachusetts).

N. Lazarus and C.D. Meyer, "Stretchable inductor with liquid magnetic core," Mater. Res. Express 3 (2016) 036103 (published Mar. 18, 2016).

* cited by examiner (a)

(b)

Stretching in direction parallel to the core axis

Stretching in direction perpendicular to core axis

DEFORMABLE INDUCTIVE DEVICES HAVING A MAGNETIC CORE FORMED OF AN ELASTOMER WITH MAGNETIC PARTICLES THEREIN ALONG WITH A DEFORMABLE ELECTRODE

GOVERNMENT INTEREST

The invention described herein may be manufactured, used and licensed by or for the U.S. Government without the payment of royalties thereon.

BACKGROUND OF THE INVENTION

Field

Embodiments of the present invention generally relate to inductive electrical components, such as inductors or transformers.

Description of Related Art

Inductors and transformers are typically constructed with magnetic core materials, such as iron, nickel or ferrites. Magnetic cores allow higher inductances to be created in a smaller volume and to improve magnetic coupling between coils. A problem with most magnetic materials is that they are rigid and thus unable to mechanically deform significantly without permanent damage.

Flexible and stretchable electronics have been proposed. The first all-polymer transistor was developed in the early nineties. Since then, stretchable and deformable electronics have found a number of important applications such as medical monitoring, stretchable displays, and wearable computing. These components have been able to undergo mechanical strains of tens of percent.

One area that has been neglected, however, is the creation of high performance inductors able to undergo similar strains. One major drawback for conventional stretchable inductors is the inability to provide the high permeability core necessary to obtain high inductance densities and magnetic coupling.

Improvements in stretchable and deformable inductive electrical components would be useful.

SUMMARY OF THE INVENTION

Embodiments of the present invention include deformable inductive electrical components, such as inductors or transformers, which are able to undergo significant strains.

According to an embodiment, a deformable inductive device includes a magnetic core formed of an elastomer material having magnetic particles dispersed in it and at least one deformable electrode. The devices are deformable in as much as they enable significant strain in tension, compression, and/or mixed modes, such as caused by twisting or bending, without failure.

Depending on a particular device's configuration, the deformable electrode may be embedded in, attached to, or in close proximity with the magnetic core. For instance, the deformable inductive device may be configured as an inductor, solenoid, or transformer and the deformable electrode is at least partially embedded in the magnetic core, in some embodiments. In others, the deformable inductive device may be configured as part of a wireless power transfer system which comprises a coil and a magnetic backplane which is the magnetic core with the coil being attached to or in close proximity to the magnetic backplane.

The elastomer material of the core, which the magnetic particles are dispersed in, may be a polymer (e.g., natural rubber or a silicone material) or a plastic material. The magnetic particles can be formed of iron, nickel, cobalt or an alloy thereof, or carbonyl iron, for example. They can be generally spherical particles or platelets. Exemplary materials for the magnetic particles include Sendust and molypermalloy (MPP) to name a few. The MPP particles can be generally spherical with an average diameter of about 30 μm and the Sendust particles can be asymmetric, flat platelets with an average diameter of about 66 μm and a thickness of about 1 μm as examples. To maintain sufficient deformability of the magnetic core and flowablity for casting, the amount of magnetic particles in the elastomer may have a ceiling—e.g., the magnetic cores may include no more than about 80% MPP by weight or 20% Sendust by weight.

Once the magnetic particles have been dispersed into the elastomer, the core material with the magnetic particles therein may be referred to herein as a "ferroelastomer" or "ferroelastomeric material," as a shorthand herein.

In some cases, the deformable electrode may be formed of at least one deformable conductive trace. The deformable conductive trace might be about 500 nm thick and 100 μm wide, for example. In other cases, the deformable electrode might be a coil having one or more turns. And, in yet other cases, the deformable electrode may be at least one deformable channel containing a containing a liquid conductor. The liquid conductor can include a liquid metal (e.g., Galinstan, eutectic gallium/indium, or mercury), a flowable elastomer or polymer having conductive particles intermixed therein, or a fluid solution containing an ionic conductor or electrolyte.

The deformable inductive device is configured to be deformable in excess of at least +5% strain (in tension), and/or may also be deformable in excess of at least −5% strain (in compression). A greater degree of stretching may be more advantageous than for compression in some instances. Or vice-versa in others. For many practical embodiments, the deformable inductive device might be configured to be deformable from about −50% strain to about 100% strain.

In further embodiments, a method for forming the deformable inductive device includes the steps of: mixing the magnetic particles in a liquefied form of the elastomer material or precursors thereof; casting the mixture around, on, or close to the deformable electrode; and then allowing the mixture to solidify. In some instances, the method further includes covering the deformable electrode, at least partially, with a first elastomer prior to casting the mixture.

These and other embodiments of the invention are further discussed below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. The drawings are not to scale unless so stated. It is to be noted, however, that the appended drawings illustrate only typical embodiments of this invention and are therefore not to be considered limiting of its scope, for the invention may admit to other equally effective embodiments. These embodiments are intended to be included within the following description and protected by the accompanying claims.

FIG. 7A shows photographs of the inductor stretched in the parallel direction, and FIG. 8A shows photographs of the inductor stretched in the perpendicular direction. FIG. 7B and FIG. 8B are plots showing measured inductance values of the inductor for various strains when stretched. FIG. 7C and FIG. 8C are plots showing relative permeability values for the inductor core when stretched;

DETAILED DESCRIPTION

Figure 1:
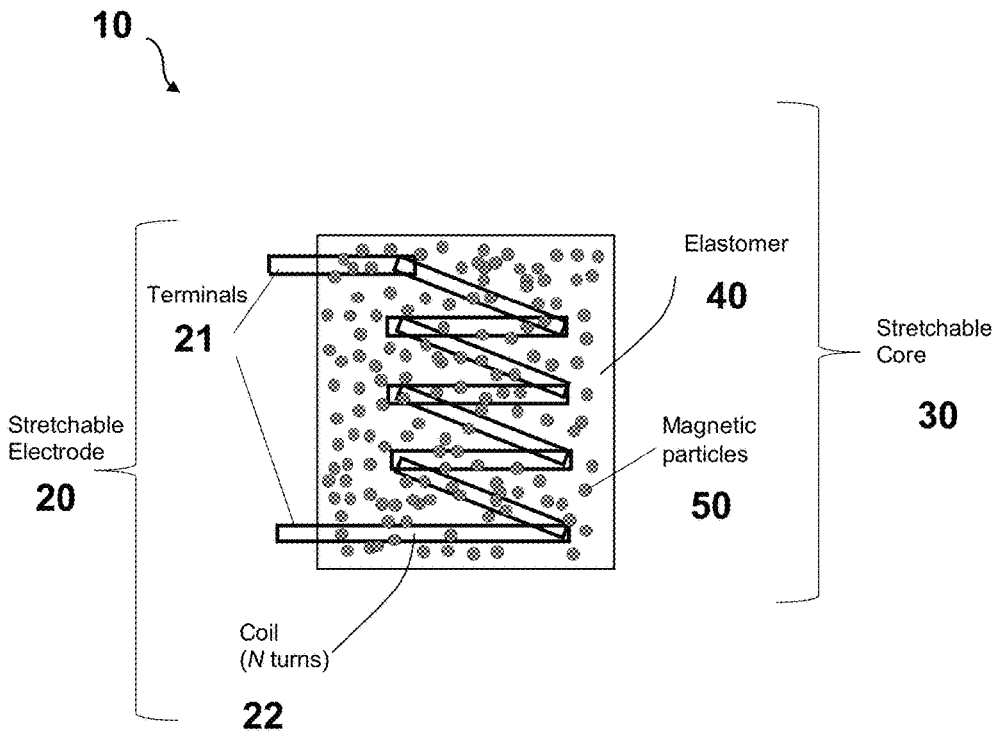
FIG. 1 is a top plan schematic showing a deformable inductor according to an embodiment of the invention.

Novel deformable electrical inductive devices are described herein. These devices include a magnetic core formed of an elastomer with magnetic particles therein along with at least one deformable electrode embedded in, attached to, or in close proximity with the magnetic core. The deformable inductive devices may be configured to generate a magnetic field or fields from electrical energy, generate an electrical energy from magnetic fields, or both. Such devices may include inductors, solenoids, or transformers, for instance. In some embodiments, the inductive device could also be used to improve magnetic coupling between coils in an electrical transformer or a wireless energy transfer system.

Being "deformable" refers herein to degree of elasticity, i.e., the ability of the device to change shape or size with force applied and then to return to original shape without permanent deformation (or plastic deformation) when the force is removed. The amount of deformation may be reported in terms of strain. Strain, as conventionally used in the art, refers to the relative change in shape or size due to externally-applied forces. It is dimensionless and thus has no units associated with it; usually, it is reported as a percentage. Tensile strain is the result of elongation or lengthening due to stretching and is generally reported as a positive value. On the other hand, compressive strain is the result of shortening due to compressing and is generally reported as a negative value. Deformations may vary in different directions and the performance thereof as a result of the geometry and/or configuration of a particular device, and the locations and amount of force(s) applied.

A greater degree of stretching may be more advantageous than for compressing in some instances. Or, perhaps, vice-versa in other instances. For practical applications of the invention, though, the novel deformable inductive device structures should be able to survive repeated strains of tens to hundreds of percent. In exemplary embodiments and applications, especially for power, the devices may be configured to be deformed from about −50% strain (in compression) to about 100% strain (in tension). This would be true in any direction of strain being applied, not just parallel and perpendicular directions. It is noted that the inventors tended to focus more on tensile strain in their initial research because that was easier to test and they believed more likely to occur for many applications (e.g., electrical devices position on the surface of the skin). Thus, while stretchable embodiments are primary disclosed herein, it should be appreciated that both tensile and compressive strains are possible for various embodiments of the invention should work equally well in both. That being said, term "deformable" as used herein is intended to encompass both tensile, compressive, and/or mixed modal strains, such as caused by twisting or bending.

While the terms "flexible" and "deformable" may be used somewhat interchangeably in the art, the inventors believe that they concern varying degrees of elasticity and is worth noting here. For instance, while there may not be universally agreed upon definitions, they agree "flexible" means a generally low amount of elasticity, e.g., less than ±5% strain, whereas "deformable" means a more substantial amount of elasticity, e.g., greater than about ±5% strain.

FIG. 1 is a top plan schematic showing a deformable inductor 10 according to an embodiment of the invention. This inductor 10 and other deformable induction devices are formed of one or more deformable electrodes 20 embedded in, attached to, or in close proximity with a magnetic core 30. The inductor 10 shown includes a single electrode coil 20 embedded within the magnetic core 30. The magnetic core 30, in turn, is formed of an elastomer material 40 having magnetic particles 50 dispersed within. This is also known as particle loading. Once loaded, the core material with the magnetic particles therein may be referred to herein as a "ferroelastomer" or "ferroelastomeric material." (It is noted that while the term "ferro-" may imply the presence iron (Fe) or ferrite in such material, it is not intended to be limited to just iron or iron alloys, and can be formed of various materials, as further described herein).

Other deformable inductive devices may be differently configured such as where the deformable electrode is attached to the magnetic core (e.g., in a magnetic backplane for a wireless power transfer system, as further discussed below). Alternatively of additionally, the magnetic core 30 of the induction device may be partially covered or fully encapsulated in a first elastomer (e.g., silicone), then ferroelastomer poured over the first elastomer. The ferroelastomer is thus not directly in contact with the magnetic core, but in close proximity to it. This configuration might be a practical implementation, in situations in which the first elastomer is used for sealing the core 30 as sealing may not be easily achieved with a ferrolastomer.

The elastomer 40 can be a polymer or plastic material that is characterizes as having a high degree of elasticity. It should be in a non-liquid (solid) state for anticipated operational temperatures of the inductor 10. In general, the elastomer 40 should be able to stretch (or compress) by a large amount without undergoing permanent (or plastic) changes in the material. This would be at least 5% strain (and/or -5% strain), but should be even much more to be practical, such as in excess of 10% strain (and/or -10% strain). Exemplary elastomer materials which can be used for the elastomer 40 may include, but are not necessarily limited to: rubber materials (including natural rubber), silicone, polyurethane and nitrile.

Polymer or plastic material by nature are not ordinary magnetic. Thus, the elastomer material 40 is to be loaded with small magnetic particles 50. For instance, the individual magnetic particles may on the order of ten microns. They may be of various shapes, such as spherical and platelet geometries, although, it has been found that platelets actually do somewhat better due to their anisotropy. The particles 50 may be formed of any soft magnetic material, such as iron, nickel, cobalt as elemental metals, as well as a large number of alloys, including such metals or others. Carbonyl iron may also be used, for instance.

Two exemplary alloys which may be used for the magnetic particles 50 in embodiments of the present invention, as discussed herein, may include: Sendust, an alloy of iron, silicon and aluminum; and molypermalloy (MPP), an alloy of nickel, iron and molybdenum. It has been found that the magnetic particles 50 may be loaded in the elastomer 40 up to certain amount at which point, the core 30 may no longer be sufficiently stretchable (and/or compressible) to be effective; the particular point may vary depending on the elastomer and/or particles used.

The magnetic particles may range in size from one the order of nanoscale to perhaps a hundred microns or greater, for example. Spherical particles of about 30 microns in diameter, or platelets of about 66 micron (along longest axis) have been found to be sufficient for some embodiments. Carbonyl iron particles in the hundreds of nanometer diameter range have also been shown to be effective. If the particles become too large, though, then there is a chance that the ferroelastomer could become too rigid.

The magnetic particles 50 may be stirred into or otherwise mixed with the elastomers 40 (or precursors of the elastomer) in a liquid state forming the core material. For example, the soft silicone, Ecoflex 00-30, is obtained as a two part formulation of liquid precursors A and B, which are mixed in equal parts to react and cure into a solid rubber material. Ideally, the particles should be uniformly dispersed in the elastomer. In the case of a thermoplastic elastomer, heat melts the material. For thermoset elastomers, precursor materials may be liquids mixed together which will react to form the elastomer. The magnetic particles can be stirred homogenously in with the liquid elastomers (or precursor materials) when being prepared.

The addition of the magnetic particles increases the inductor density of deformable elastomer 40 and create a deformable magnetic core 30. In other words, the elastomer material retains most of its elastic properties with the addition of the magnetic properties, such as increased permeability. Permeability is the measure of the ability of a material to support the formation of a magnetic field within itself. In the art, it is typically represented by the (italicized) lowercase Greek letter Mu (μ). In SI units, permeability is measured in henries per meter (H/m or $H \cdot m^{-1}$), or newtons per ampere squared ($N/A^2$ or $N \cdot A^{-2}$). According to preliminary findings, increased permeability had been shown by a factor of 3 using a ferroelastomeric material compared with conventional core materials. With other materials and better process control, permeability could approach an increase of ten or more. Inductance values could range from nanohenries to hundreds of microhenries, and permeability from one to hundreds, for instance.

The deformable electrode 20 can be embedded or encapsulated in the core material (i.e., the ferroelastomeric material) while is in a liquid state. The core material may be poured or casted around the deformable electrode 20, for instance. Then the core material cools or reacts to solidify about the electrode 20 forming the core 30. A mold may be used to shape the core material to its shape and size. Excess core material may be milled or machined to provide final dimensions to the core 30, if so desired. The deformable electrode 20 can be fully or partially encapsulated in the core 30. The terminals 21 of the electrode 20 as shown are exposed for connecting to an electrical circuit (not shown), in any conventional manner. While they are shown as non-encapsulated in this drawings, the terminals and circuit might be fully encapsulated in other embodiments. In practice, the deformable inductive components could be sized to be on the order of centimeter scale in some cases; if smaller than that there may not be a need for the device to be stretchable/compressible, and if too much larger, the devices could become too large and impractical for conventional-type use.

The deformable electrode 20 may be any inductive element. As shown, the electrode 20 is a coil element 22 having one or more turns. Adding additional turns to an inductor coil is a common method for increasing the inductance density, and also results in a higher coupling for inductive power transfer. For this particular type of device, a coil 20 with turns of a few millimeters to a hundred millimeters in diameter may be sufficient; too small, there may be no need for deformability (e.g., stretchability); too large, and it may not be very useful for certain applications, such as inductive sensors located on the human body.

The deformable electrode 20 is formed of one or more electrical conductors. It may be 2-D planar (in the case or a simple trace) or 3-D (in the case of a complex trace or multi-turn coil) in shape. In some embodiments, the deformable electrode may be a pre-deformed (or pre-wrinkled) conductive trace, formed of a deformable electrically conductive metal, such as copper or gold. These electrodes have a generally serpentine- or accordion- shaped structure with one or more deformable sections that are configured to minimize internal stresses when stretched (or compressed). Exemplary techniques for forming stretchable conductors have previously been described by S. P. Lacour, S. Wagner, Z. Huang, and Z. Suo, "Stretchable gold conductors on elastomeric substrates," Applied Physics Letters, vol. 82, no. 15, April 2003, 2404-2406, and N. Lazarus, C. D. Meyer and S. S. Bedair, "Stretchable Inductor Design," IEEE Transactions on Electron Devices, vol. 62, no. 7, pp. 2270-2277, July 2015, herein incorporated by reference in their entireties. These techniques can likewise be used to form stretchable and/or compressible electrodes according to embodiments of the present invention.

Figure 2A:
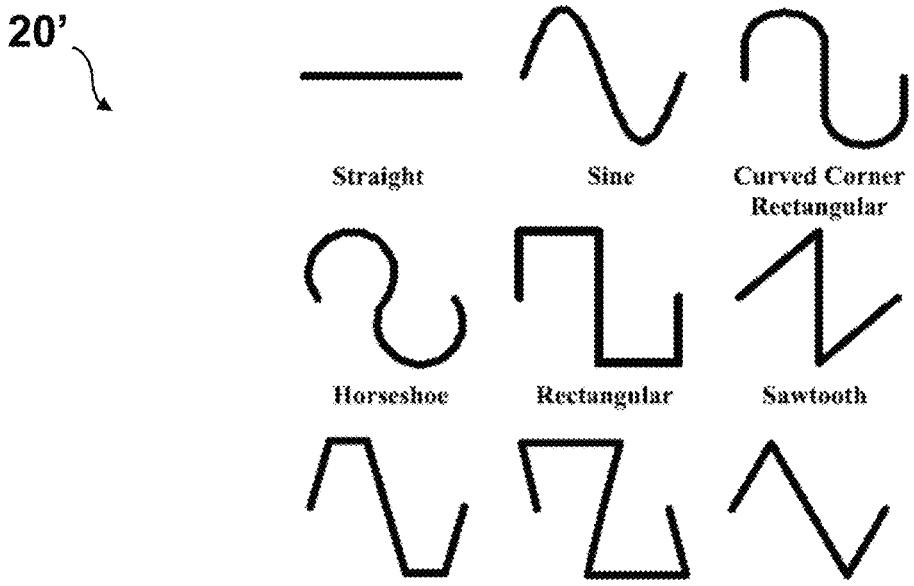
FIG. 2A shows various deformable conductor trace shapes which may be used in accordance with embodiments.

A deformable electrical trace is a structure similar to a 2-D or 3-D spring. Components of the trace oriented along the direction of applied strain result in a stiffer structure than portions transverse to this strain. Sharp corners, hwever, can concentrate stress and can cause breakage earlier than more gradual changes of direction. FIG. 2A shows various trace shapes 20' which are deformable which may be used. They include straight, sinusoidal curved corner, horseshoe shaped, rectangular and triangular sawtooth, and many trapezoidal shapes, as examples. The traces may be formed of copper and be about 500-nm thick and 100-μm wide, for example.

Figure 2B:
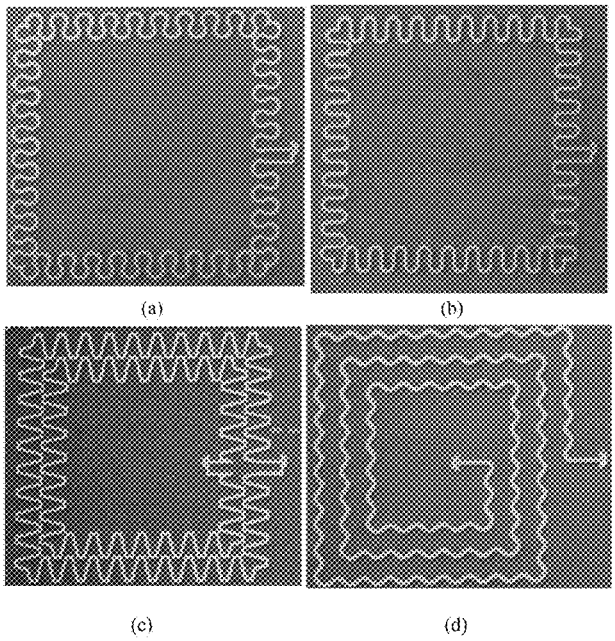
FIG. 2B shows photographs of four fabricated deformable wavy inductor traces.

FIG. 2B shows photographs of four fabricated deformable inductor traces having wavy inductor traces. A one-layer metal lift-off process was used to pattern 500-nm-thick copper inductors on a 2-nm chromium adhesion layer. A trace width of 100 μm was used to maintain consistency with the modeling results. Three sets of inductors were fabricated, all square with 10-mm outer diameter. The first two traces (a) and (b) are one-turn inductors based on each form of interconnect. The mutual inductance is small (~20% of the total inductance), and the self-inductance is, therefore, going to dominate the overall inductor performance. In the third trace (c), two single-turn inductors are shown, one nested within the other, enable mutual coupling between the deformable interconnect. Finally, in the fourth trace (d), a set of three-turn inductors provides higher inductance density.

In other embodiments, the deformable electrode 20 may be formed of at least one deformable channel containing a liquid conductor. The channel(s) may be fabricated of a deformable conduit which holds said conductor. The liquid conductor may be a liquid metal, such as Galinstan (an alloy of gallium, indium and tin), eutectic gallium/indium, or mercury. Liquid polymer composites could also be used; these can include flowable elastomers loaded with conductive particles, like carbon nanotubes or gold nanoparticles. Alternatively, aqueous conductive solutions of ionic conductors or electrolytes, such as salt water loaded hydrogels, for example, can also be used. It is noted that while aqueous (water) solutions can be used, they can be problematic for the reason water tends to evaporate very easily. Thus, fluid solutions of ethylene glycol, propylene glycerin, and glycol with the ionic conductors or electrolytes can be used instead, for example.

The liquid conductors flow to conform to the surrounding channel when stretched or otherwise elastically deformed. A liquid metal inductor was described in A. Fassler and C. Majidi, "Soft-matter capacitors and inductors for hyperelastic strain sensing and stretchable electronics," Smart Mater. Struct., vol. 22, 2013, 055023 (8pp), herein incorporated by reference it its entirety. That article reports forming capacitors and inductors composed of microchannels of Galinstan alloy embedded in a soft silicone elastomer (Ecoflex® 00-30). A technique for fabricating a non-magnetic core inductor using liquid metal was reported in Lazarus, N.; Meyer, C. D.; Bedair, S. S.; Nochetto, H.; Kierzewski, I. M. "Multilayer Liquid Metal Stretchable Inductors," Smart Mater. Struct. 2014, 23, 085036, herein incorporated by reference it its entirety. This article describes using 3-D printed molds to create multilayer open channels in soft silicone, which are then sealed by bonding to partially cured silicone. Galinstan or other liquid metal is then injected into the channels to form deformable conductive traces. This same technique can be extended to use ferroelastomers.

The inductor 10 may be configured to be deformed and sufficiently maintain conductive performance during tension (stretching), compression (squeezing), and/or mixed mode deformations, like twisting, while maintaining or controlling performance. Deformation may be characterized in terms of strain. As known in the art, the term "strain" is defined as the amount of deformation due to stretching (and/or compressing) an object experiences compared to its original size and/or shape. Strain is typically given as dimensionless or normalized values. Uniaxial strain is strain which is substantially related to, or affecting, substantially only one axis. Biaxial strain is strain in two perpendicular axes. The degree of deformation as a function of stress, i.e., strain, may vary in different directions and the performance thereof as a result of the geometry of the device. FIGS. 7 and 8, discussed below, compare stretching along two different directions.

This novel technology opens up a broader range of applications that are currently impossible with rigid conventional magnetic core inductors and which have been impractical for conventional stretchable ones due to the lower performance. The novel deformable inductive devices may be used for a variety of application, such as bio-medical monitoring, strain (e.g., mechanical displacement) sensing, and stretchable RF ID tags intended to be attached to a surface such as human skin, for example. Other applications include creating a mechanically tunable inductor (allowing an inductor-capacitor circuit used in a transmitter or receiver to be tuned by mechanically stretching or compressing the inductor). Stretchable (and compressible) inductors and transformers for electrical power conversion are also envisioned, which require highly efficient and low resistance components to minimize power losses, and can be used for applications in power generation (in allowing conversion systems to be placed in close proximity to an energy source such as a solar cell mounted on a helmet, which requires the inductor to conform to a non-planar or irregular surface). These novel deformable power conversion elements could lead to a truly deformable computer. Other potential applications of the technology include stretchable filters, communication circuitry, among many other possibilities where conventional inductors are used.

Experimental results of using the magnetic core stretchable (deformable) inductor have shown it to be able to undergo very large strains and maintain high operational performance. The resulting composite retains most of the mechanical properties of the elastomer while adding a magnetic response, including relative permeability greater than one, because of the embedded particles.

As mentioned above, the inventors primarily investigated the use of ferroelastomers for stretchable electronics. By incorporating magnetic particles, the first magnetic-core stretchable inductor is demonstrated, an inductor based on liquid metal around a ferroelastomer core. Using ferroelastomers resulted in much higher permeability and resulting inductance density compared with nonmagnetic elastomers. With the magnetic particles, unstretched inductance was increased up to 2.9 times that of an inductor with the original elastomer core, while surviving strains up to 100%. Galinstan (melting point of −19 ° C.) was chosen by the inventors for the electrodes to minimize resistance, because liquid inductor traces have been demonstrated to survive strains of up to about 200% with cross-sections as large as millimeters. The elastomer used was the soft silicone Ecoflex 00-30 (Smooth-On), with a breakage strain of 900% and an elastic modulus at low strain of approximately 125 kPa.

Figure 3:
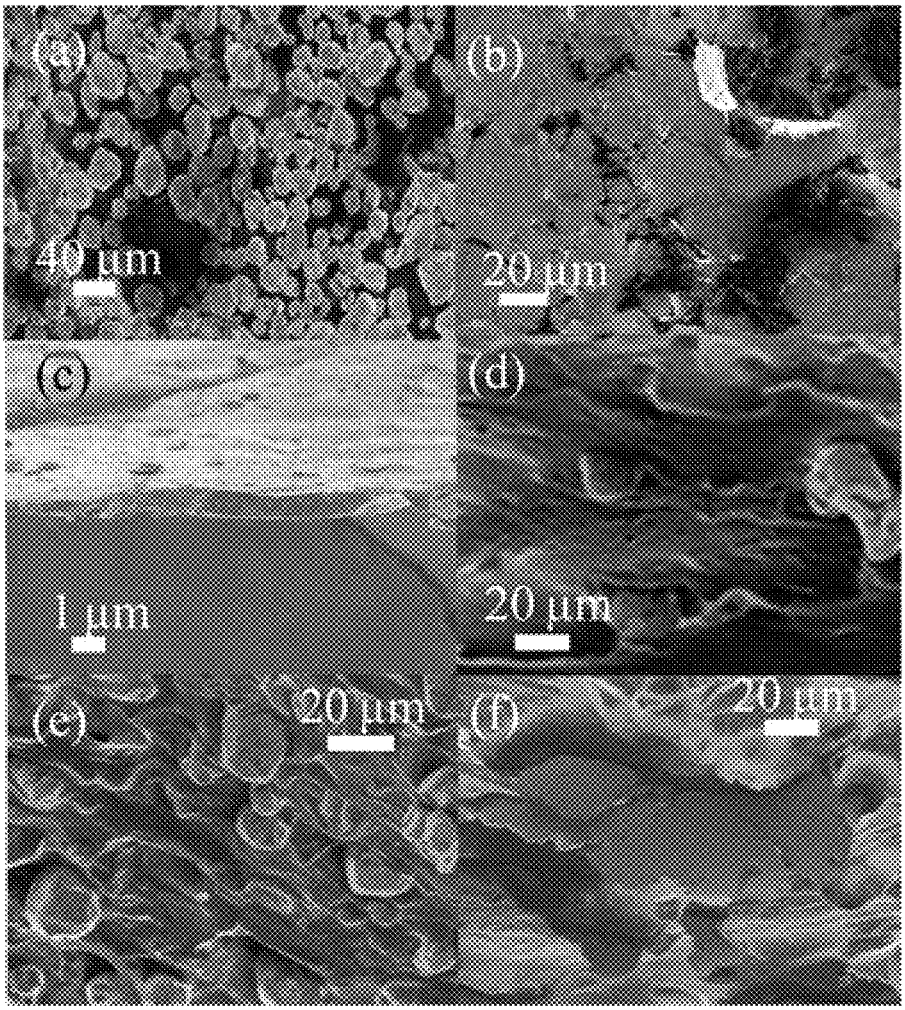
FIG. 3 shows various microscope images of magnetic particles before being coated: (a) molypermalloy (MPP), (b, c) Sendust, and after mixing in elastomer: (d) 60% and (e) 80% by weight MPP and (f) 20% by weight Sendust.

FIG. 3 shows various SEM images of magnetic particles before being coated: (a) MPP, (b, c) Sendust, and after mixing in elastomer: (d) 60% and (e) 80% by weight MPP and (f) 20% by weight Sendust. To put this in perspective, the amount of polymer in conventional powder core inductors is less than 10% by volume (3-4% by weight), which is far too low for practical stretchable applications.

The ferroelastomers investigated were created using one of two different commercially obtained magnetic particles, molypermalloy powder (MPP) (Spang and Co.) and Sendust (Steward LP987). Molypermalloy is a nickel-iron-molybdenum alloy (79% Ni, 17% Fe, 4% Mo) having a bulk relative permeability of 20,000. The MPP was made by grinding bulk molypermalloy and sieving to a desired mesh size; as a result, a 400-mesh (maximum particle size about 37 μm in diameter) powder was produced and consisted of a range of sizes, primarily in the tens of microns, with a roughly spherical or "boulder-shape" (image (a)). This mesh/particle size was chosen as the smallest size commercially available for MPP.

Sendust (85% iron, 9% silicon, 6% aluminum) has a similarly high relative permeability range from 16,000 to 36,000. The Sendust powder was formed from flat sheets (image (b)) with thickness approximately 1 μm (image (c)) to produce very asymmetric, flat platelets with average diameter of about 66 μm and thickness of about 1 μm.

Both Sendust and MPP were selected by the inventors because they are highly packed magnetic powders with a small quantity of binding polymer used for structure and isolation. The MPP powder and Sendust were mixed into liquid silicone precursors before curing to create the magnetic core material composite. Adding the magnetic powders resulted in an increase in the viscosity of the mixture. The maximum usable concentration occurs when the liquid becomes too viscous to be poured for molding. The MPP mixture remained pourable up to 80% molypermalloy by weight, while the Sendust became too viscous above 20% by weight. The difference in viscosity is likely due to particle shape, with long thin Sendust platelets affecting the shear forces within the fluid more than the smaller spherical MPP. Dense powders also gradually settle during curing, resulting in a surface layer in the elastomer largely void of the filler material. To minimize settling, the elastomer were rapidly cured at 85° C. on a hot plate, with final cure occurring in less than 30 min.

Magnetic composites can be treated as magnetic circuits, where magnetic flux is inversely proportional to the closed path line integral of magnetic field by a quantity defined as reluctance, a magnetic circuit analog to electrical resistance. Both MPP and Sendust have a relative permeability in the tens of thousands, compared with non-magnetic silicone. Highly magnetic particles behave as effective "shorts," i.e., approximately zero reluctances, and are surrounded by regions of high-reluctance silicone (magnetically free space). The overall permeability is therefore set, not by the permeability of the particles themselves, but by the width and number of gaps between neighboring particles. The average number of gaps and width of each defines the total distance through nonmagnetic silicone that the magnetic field must pass through within the core, known as the "distributed air gap" of the inductor, and the ratio between the total core length and this value is approximately the relative permeability. As packing density increases, the spacing between particles falls.

Each of ferroelastomer materials was cut after curing and examined using a scanning electron microscope to estimate particle spacing. With 60% MPP by weight (16% by volume), the gap between neighboring particles is tens of microns (image (d)). As the MPP loading increases to 80% by weight (33% by volume), this gap drops to less than ten micrometers (image (e)). The Sendust platelets are more isolated because the maximum loading is only 20% by weight (4% by volume) (image (f)). However, because the sheets of Sendust are highly anisotropic, very long, and thin, the number of gaps between particles to create a complete magnetic path will also be shorter than the more spherical MPP. No additional magnetic field was applied during curing, so there is no preferred alignment for the Sendust platelets. Sheets of Sendust that happen to be aligned with a magnetic field will effectively short out large regions of silicone.

To determine the relative permeability, commercially-available air core inductors (Coilcraft 2929SQ-501, nominal inductance 500 nH) were encapsulated in Sendust- and MPP-based ferroelastomers and compared to a similar inductor in nonmagnetic silicone. The precise orientation, sizing, and positioning of the individual particulate is effectively random; thus, creating an exact model of the permeability not feasible. Instead, effective medium theory was used, where assumptions about the general shape and distribution of particles are used to approximate the behavior. The Maxwell Garnett model assumes ellipsoid particles, evenly distributed and far enough apart that particles are only weakly interacting, and is valid for the relatively low fill fractions in this work. Within these assumptions, permeability follows the relationship:

$$\frac{\mu_{eff} - \mu_1}{\mu_{eff} + 2\mu_1} = f\frac{\mu_2 - \mu_1}{\mu_2 + 2\mu_1} \tag{1}$$

where $\mu_{eff}$, $\mu_1$, and $\mu_2$ are permeabilities of the composite, surrounding medium, and particle inclusions, respectively, and f is the volume fill fraction of the inclusions. The shape of an ellipsoid also acts to reduce the effective magnetic moment within a particle, according to a geometric term known as the demagnetizing factor. The demagnetizing factors of the three axes must sum to one.

The molypermalloy particles can be treated as roughly spherical; because spherical particles are isotropic, the demagnetizing factors for each axis will be equal to ⅓, resulting in no impact from the orientation of individual particles.

Figure 4:
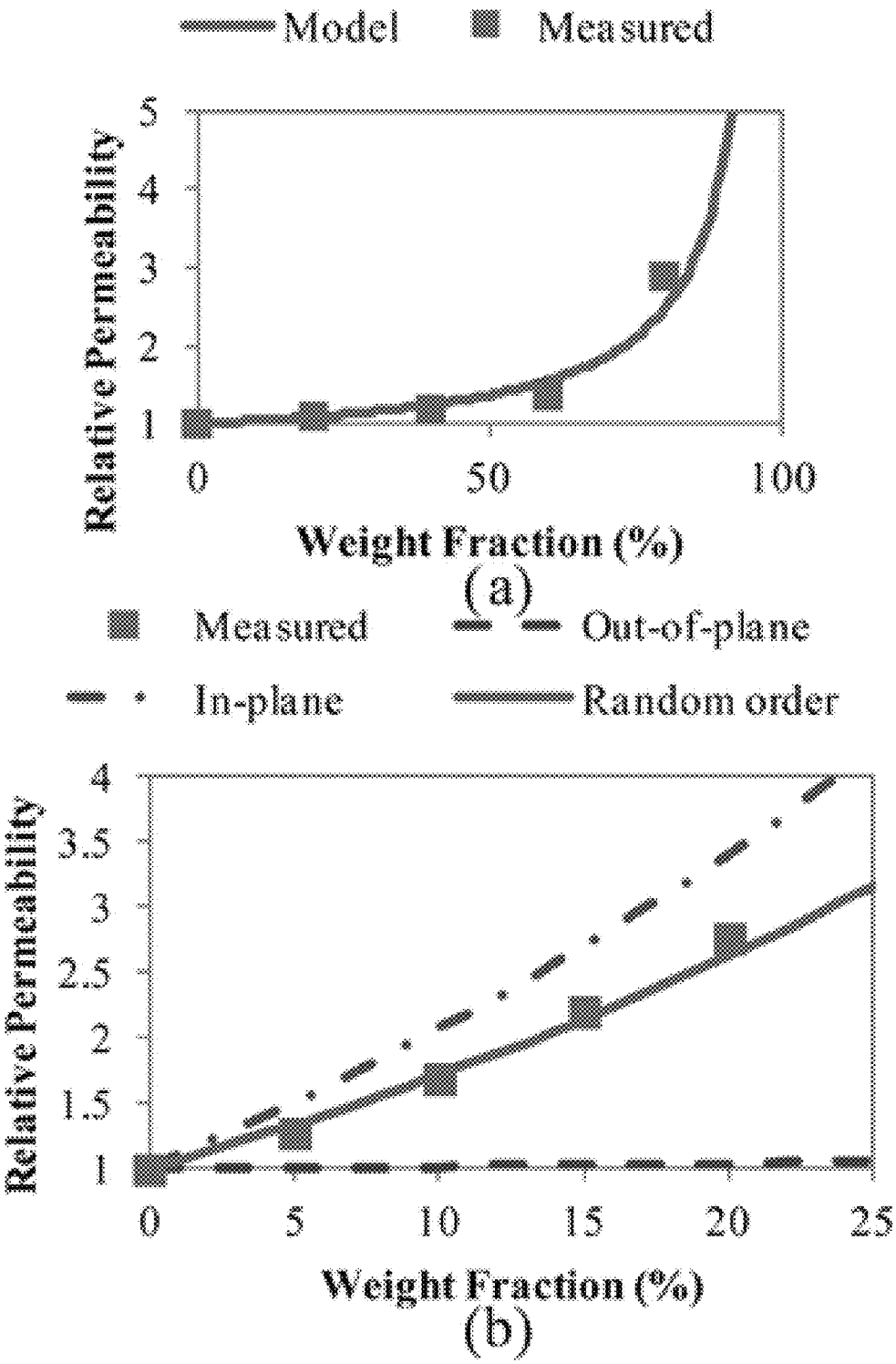
FIG. 4 includes plots for the relative permeability of (a) MPP and (b) Sendust ferroelastomer with varying loading fractions of magnetic particles.

FIG. 4 includes plots for the relative permeability of (a) MPP and (b) Sendust ferroelastomer with varying loading fractions of magnetic particles. Plot (a) shows measured relative permeability for different loading fractions of MPP, along with expected results using the model. The average particle diameter used in the model was 22.3 which was estimated by measuring the size distribution of particles optically. The Sendust particles, on the other hand, are very asymmetric, flat platelets with average diameter of about 66 μm and thickness of about 1 μm. The demagnetization factor for a platelet is very close to zero in plane, and approximately normal to the plate (assuming a flat disk with the Sendust dimensions, 0.163 and 0.968 for in plane and out of plane respectively). The orientation therefore makes a large difference in the resulting permeability. If all the plates are normal to the magnetic field, almost no silicone is magnetically shorted by the particles, and the relative permeability will be close to 1. When plates are completely aligned with the applied field, the permeability will be maximized. In the Sendust-loaded composite, platelets are randomly ordered, with no preferential alignment direction; some plates are aligned in parallel with the field, resulting in shorting of long lengths of silicone, whereas others will be angled and have lower impact. In the model, this randomization is incorporated by assuming a third are aligned with each axis because of the lack of a preferential direction. Plot (b) of FIG. 4 shows measured permeability for the Sendust composite closely follows the expected permeability for random ordering.

As the fraction of magnetic particulate in the ferroelastomer increases, the effective stiffness of the ferroelastomer will rise because of two effects: the weighted combination of the stiffness of the two constituents is higher, and the particles provide additional cross-linking sites that restrict the mobility of the polymer chains. Because the magnetic particles are orders of magnitude stiffer than the polymer matrix, the blend results in a gradual increase in mechanical strength and effective elastic modulus of the bulk composite material as the volume fraction of particulate increases. As with the magnetic behavior, particle shape plays an important role. Long narrow platelets, with a high surface area to volume ratio, interact more strongly with the neighboring polymer than spheres with similar volume.

Figure 5:
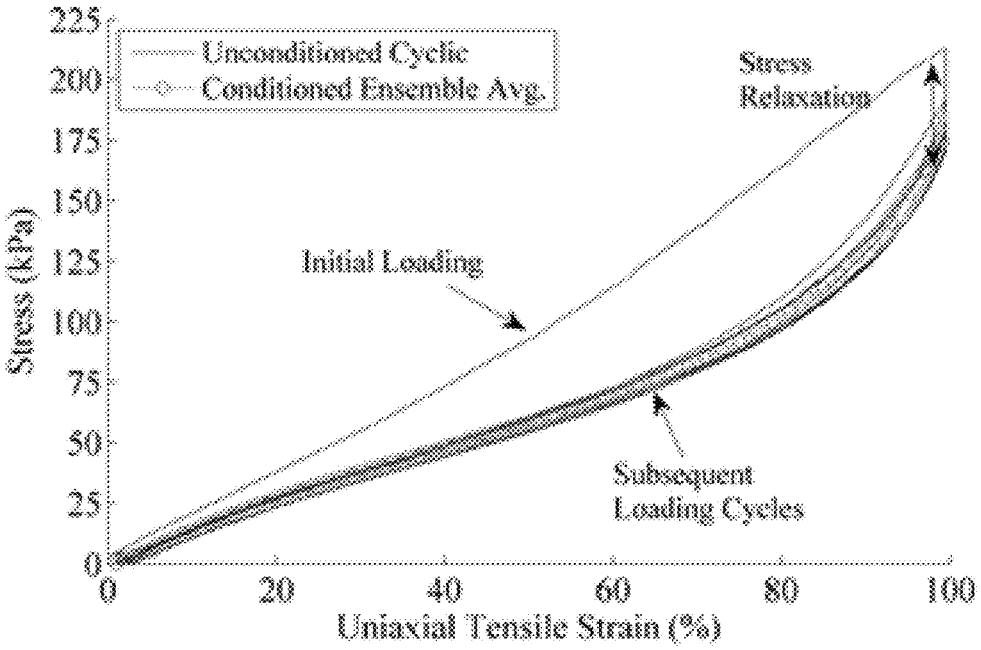
FIG. 5 shows plots detailing results of (a) cyclic loading data for 20% by weight Sendust ferroelastomer and (b) stress—strain curves of MPP- and Sendust-based ferroelastomers.
Figure 5:
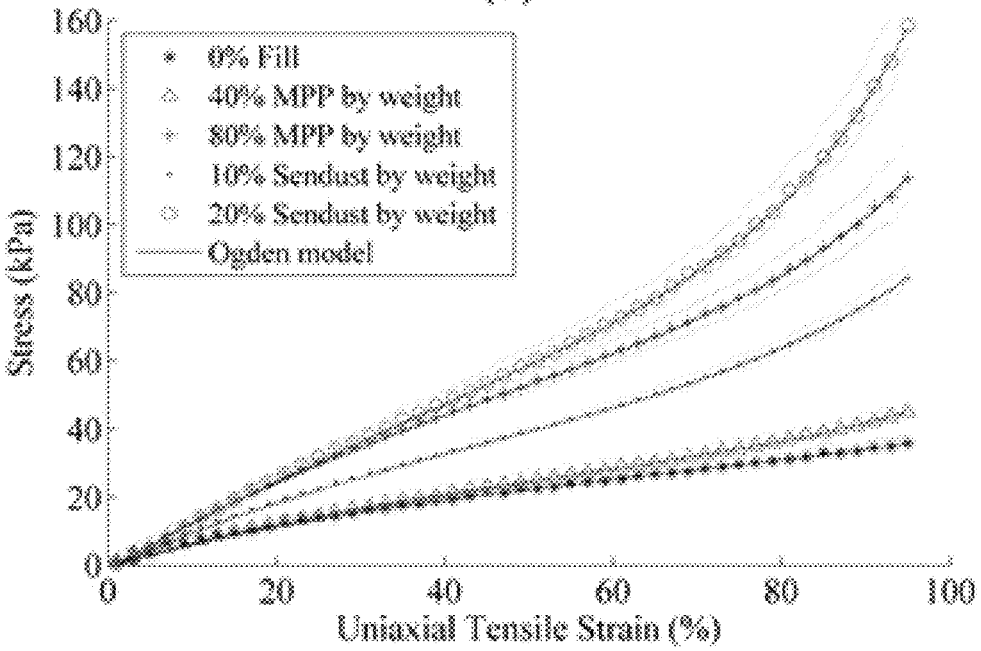

FIG. 5 shows plots detailing results of (a) cyclic loading data for 20% by weight Sendust ferroelastomer and (b) stress—strain curves of MPP- and Sendust-based ferroelastomers.

The combined strain-softening and strain-hardening behaviors of hyperelastic rubber materials, such as silicone, are well-described by the Ogden model. The elastomer is assumed to be incompressible, with a Poisson's ratio approximately 0.5, and thus the volume of the material is conserved during deformation. (Note: when it is said that the "elastomer is assumed to be incompressible," that does not mean that it cannot experience a compressive strain; incompressible in this context means that it does not change in volume/material density, i.e. that if you compress it along one or two axes, the elastomer compensates by expanding along the remaining axes to hold the volume constant).

During quasi-static uniaxial strain testing, the elastomers were found to experience significant stress relaxation, with the initial loading cycle having a stiffer response before softening to approach a steady-state elastically reversible behavior in subsequent loading cycles. This is apparent in plot (a) of FIG. 5.

Because the Ogden model assumes that the stress—strain curve is completely reversible, the samples were first conditioned by applying multiple loading cycles to reach consistent behavior. An ensemble average of multiple stress—strain curves covering multiple cycles and multiple specimens was obtained after conditioning ferroelastomers loaded with 40 and 80% MPP as well as 10 and 20% Sendust by weight. The results are show in plot (b) of FIG. 5. A four-parameter Ogden model was then obtained using a nonlinear regression on the ensemble averages for each formulation. Increasing particle volume fractions results in two primary changes in the quasi-static mechanical behavior of the bulk material: (1) effective stiffness increases, and (2) the strain softening and strain hardening effects are amplified. For the same mass loading fraction, both effects are much more pronounced in the Sendust loaded samples.

For example, looking at plot (b) of FIG. 5, it can be seen that the 20% Sendust by weight sample has a stress—strain curve that tracks closely to the stress—strain curve for 80% MPP by weight sample. The effect of the large platelet area counteracts the difference in volume loading. This effect parallels the previously mentioned effect on viscosity observed in the precured ferroelastomers. The Sendust-based ferroelastomers are thus mechanically similar to the MPP-based elastomer with comparable permeability, although with far lower mass density and resulting sample weight in the final composite.

In a deformable magnetic core, one of the most important characteristics is the change in effective permeability when the composite is deformed. Stretching (or compressing) a ferroelastomer results in a change in the relative position of rigid particles within the magnetic composite. Because magnetic particles are orders of magnitude more rigid than the surrounding silicone, the deformation occurs primarily in the soft elastomer. As the composite is stretched, for instance, the particles move farther apart along the strain axis, resulting in a larger spacing between the individual particles in the direction of stretching. Poisson's effect leads to a corresponding decrease in particle spacing in the directions normal to the direction of stretching. The resulting increase in the effective gap along the magnetic core and corresponding reduction in cross-section geometry is expected to result in a drop in permeability as the core is stretched.

Because the inductance of an inductor is primarily dependent on the permeability within the core, non-magnetic silicone (Ecoflex®) was used for the top and bottom sealing layers. This allows the deformable electrode traces to be observed during liquid metal fill and testing, because the partially transparent silicone becomes dark and opaque when loaded with magnetic particles. Both inductors with applied strain direction along and perpendicular to the core direction were tested to determine if the permeability became anisotropic during deforming.

The inventors have investigated silicone loaded with magnetic particles for creating a composite with higher permeability while still maintaining stretchability. The deformable inductive devices investigated were fabricated generally following the technique described in the aforementioned Lazarus et al., Smart Mater. Struct. 2014 article by substituting ferroelastomer for the silicone molded layer. Magnetic and mechanical properties were first characterized for composites based on both spherical and platelet particle geometries. The magnetic-core stretchable inductors were then demonstrated using the resulting ferroelastomer. Inductors based on liquid metal galinstan were then demonstrated around a ferroelastomeric core. Results shows that they can effectively operate when stretched to uniaxial strains up to about 100%. Soft elastomers loaded with magnetic particles were found to increase the core permeability and inductance density of stretchable inductors by nearly 200%.

Figure 6:
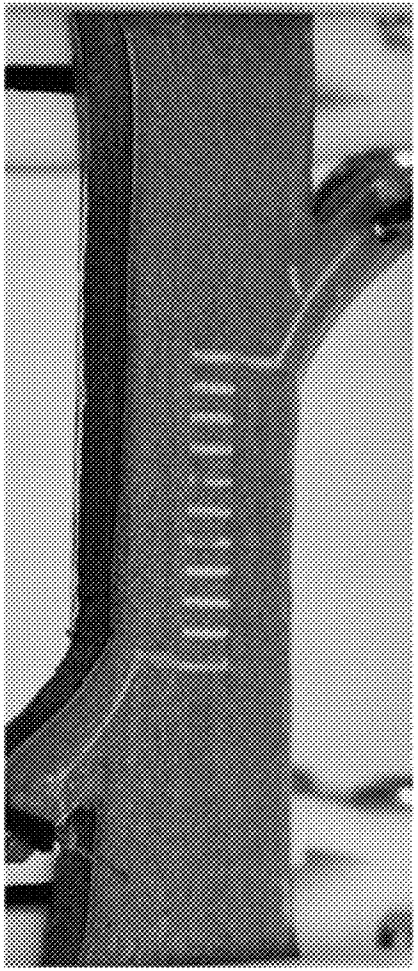
FIG. 6 is a photograph of the uniaxial testing machine setup that was used by the inventors to stretch a deformable inductor according to an embodiment in directions both parallel and perpendicular to the core axis.

The inductors with ferroelastic cores formed of 20% Sendust and 80% MPP were subjected to testing using a uniaxial testing machine setup to measure the effects of inductance and permeability as the inductors were stretched. FIG. 6 is a photograph of the uniaxial testing machine setup. The ends of the cores of both the inductors were each securely clamped in the machine. The uniaxial testing machine is configured to stretch the inductor in directions both parallel and perpendicular to the core axis. The inductors were stretched in both directions over various tensile strains, ranging from 0 to 100%.

Figure 7A:
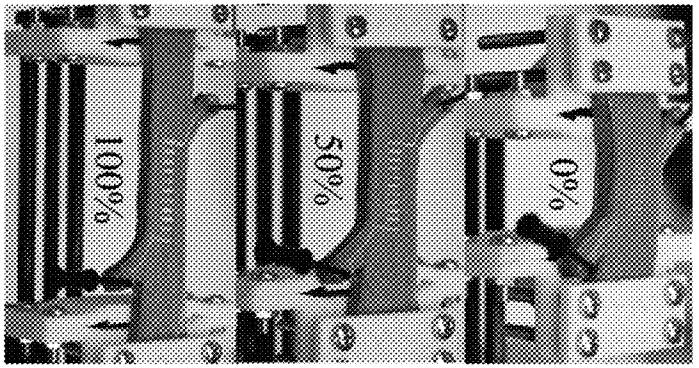
FIGS. 7A-C and 8A-C show results of mechanical stretch testing of deformable inductors conducted by the inventors.
Figure 7B:
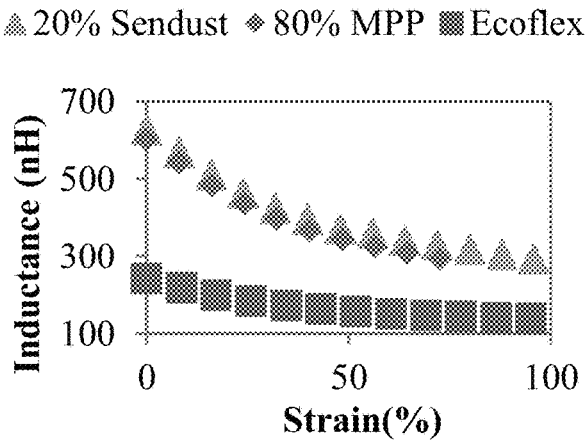
Figure 7C:
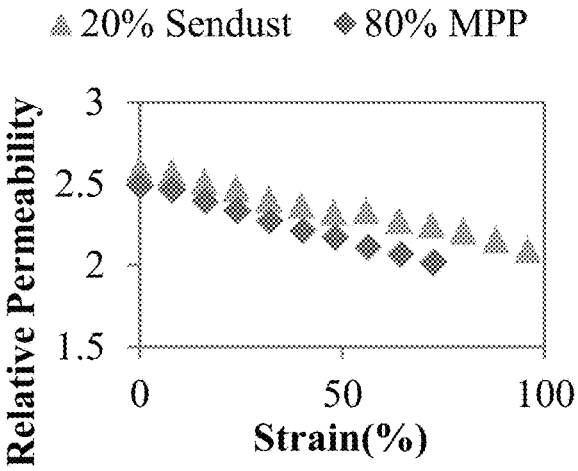
Figure 8A:
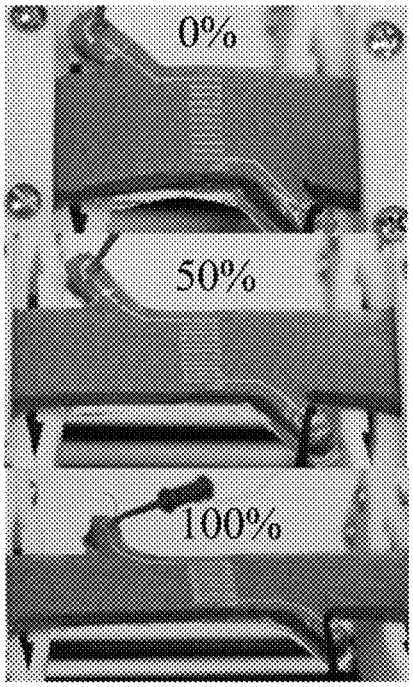

FIGS. 7A-C and 8A-C show results of mechanical stretch testing of the 20% Sendust and 80% MPP inductor cores conducted by the inventors. FIG. 7A shows photographs of the inductor stretched in the parallel direction (with pulling from the left and right sides) for strains of 0, 50 and 100%, and FIG. 8A shows photographs of the inductor stretched in the perpendicular direction (with pulling from the top and bottom sides) at those same general stain levels.

Figure 8B:
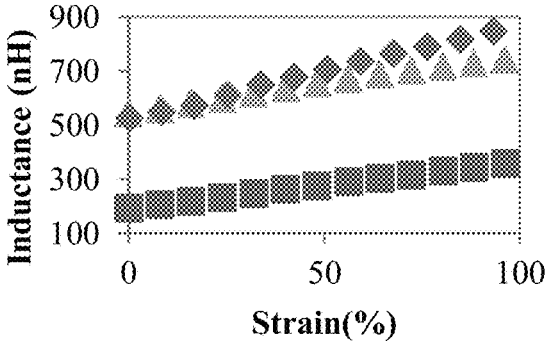

The corresponding plots of FIG. 7B and FIG. 8B show measured inductance values of the inductor for various strains, when stretched, in the directions parallel to the core axis and perpendicular to the core axis, respectively. For the inductance plots, results of stretching a conventional core of Ecoflex with no magnetic particle loading is also shown for comparison sake.

The inductance of a coil is dependent on its geometry, allowing use as a hyperelastic strain gauge. In general, the results shows that the inductor stretched along its core axis drops in inductance, while the same strain perpendicular to the core axis increases the inductance. The inductance varies both due to the changing geometry as well as the variation in the effective permeability of the ferroelastomer. For strains parallel to the core, both materials exhibit comparable behavior, with measured inductances being almost indistinguishable between the two composites at each tested value of strain. However, for large strains perpendicular to the core, the Sendust-based inductor exhibited lower inductance than the comparable MPP sample.

Figure 8C:
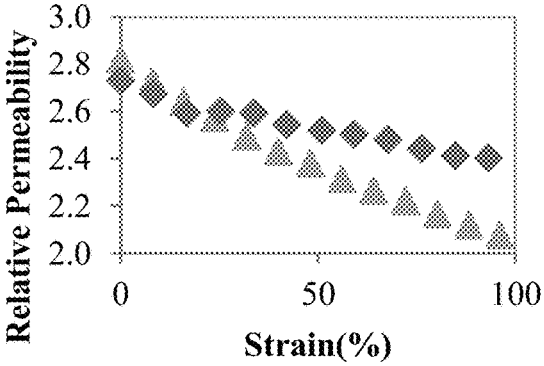

The plots of FIG. 7C and FIG. 8C show relative permeability values for the inductor cores when stretched, in the parallel and perpendicular directions, respectively. Because the magnetic fields of an inductor are concentrated in the core, the inductance is proportional to the magnetic permeability of the core material. Approximate permeability can therefore be calculated by dividing by the nonmagnetic core inductance at a given strain value.

Permeability drops for both perpendicular and parallel mechanical strains in both materials; the lower inductance for the perpendicular strains in the Sendust material is reflected in a larger drop in the relative permeability. The drop in permeability for both directions of mechanical strain results from an increase in the average particle spacing in the material. In an incompressible material, such as an elastomer at moderate strains, particle spacing increases linearly in the direction of applied strain, while along the other two axes it drops more slowly according to a square root relation. When the particles are initially randomly distributed, this difference in behavior results in most particles moving farther apart (more than 80% of possible particle positions for the strains). A five cycle loading test to 40% maximum applied uniaxial strain was also performed on each of the two ferroelastomers, finding no clear change in inductance density and permeability behavior with cycling.

Using magnetic materials as the ferroelastomers allows for larger inductance densities to be reached in stretchable (or compressible) inductors. Although the relative permeability remains small relative to traditional core materials, it represents a nearly 200% increase in the inductance of the inductor compared to nonmagnetic silicone. With platelet-type particulate, this increase requires only a 25% increase in mass density of the elastomer. Deformable magnetic-core inductors represent an important development for improving communication and power systems in highly compliant systems. The deformable magnetic-core may be ideal for tunable inductive devices. The same material is also well-suited as deformable magnetic backplanes for wireless power.

Figure 9:
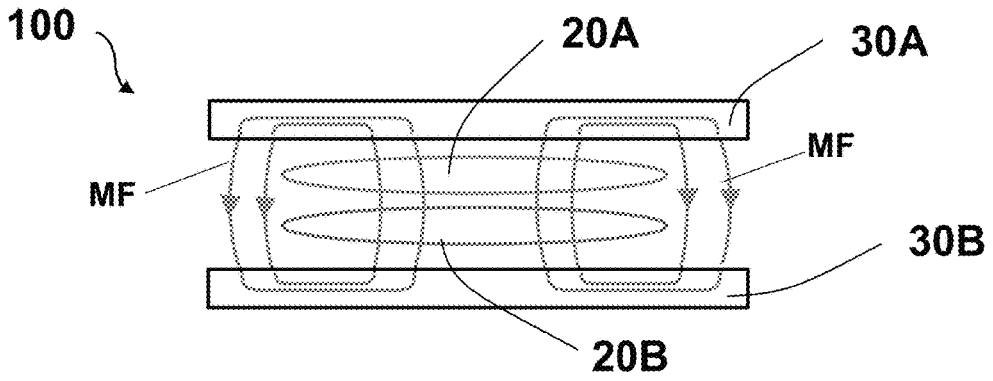
FIG. 9 shows a deformable wireless power transfer system comprising deformable coil traces formed on deformable magnetic backplanes according to another embodiment.

FIG. 9 shows a deformable wireless power transfer system 100 comprising deformable coil traces 20A, 20B formed on deformable magnetic backplanes 30A, 30B according to another embodiment. The deformable coils 20A, 20B may be fabricated as deformable electrode 20, discussed above, which are inductors suitable for wireless power transfer.

Magnetic materials are used for wireless power applications. Conventional magnetic backplanes have been formed of a rigid magnetic material such as ferrite which high resistance minimizes eddy currents and resulting losses, but cannot significantly function when subject to strain. By contrast, rather than using a rigid magnetic backplane, the deformable magnetic backplanes 30A, 30B are formed of the ferroelastomer material which, not only makes them magnetic, but also stretchable (and compressible). In the inductive wireless power transfer system 100, the two inductors, one serving as a transmission coil 20A and the second as a receiver coil 20B, are placed in close proximity. When a time-varying current is passed through the transmission coil 20A, magnetic field lines are generated that pass through the second coil 20B and create an opposing current there, resulting in energy transfer. In the absence of magnetic material, fields would radiate a moderate distance from the two coils 20A, 20B, resulting in lower mutual and self-inductance and undesired energy losses through leakage magnetic fields. Thus, to better guide the magnetic flux MF, magnetic backplanes 30A, 30B may be provided on one or both sides of the coils to restrict the magnetic flux MF to better improve the coupling between the two coils 20A, 20B.

The coil 20A and the backplane 30A may be integrally formed together as a transmitter inductor, and similarly, the coil 20B and the backplane 30B may be integrally formed together as a received inductor (or vice-versa). For example, the inductors may be fabricated with two layers of silicone (one molded, one blank sealing layer), with channels formed in between; for the magnetic backplane, the molded layer is made of ferroelastomer. Alternatively, a channel or deformable inductor trace may be bonded, adhered, glued, or otherwise joined to the surface of a block of ferroelastomer to use it for improved wireless power coupling.

The deformable nature of both the coil traces and the backplanes, enables them to stretch (or compress) while still remaining operational even for high levels of strain. For example, the thickness could range from sub-millimeter to a few millimeters in practice; the length and width would be set by the size of the inductor, so probably up to a hundred millimeters or so. For optimal performance, the backplane could extend a little ways beyond the edge of the coil.

Figure 10A:
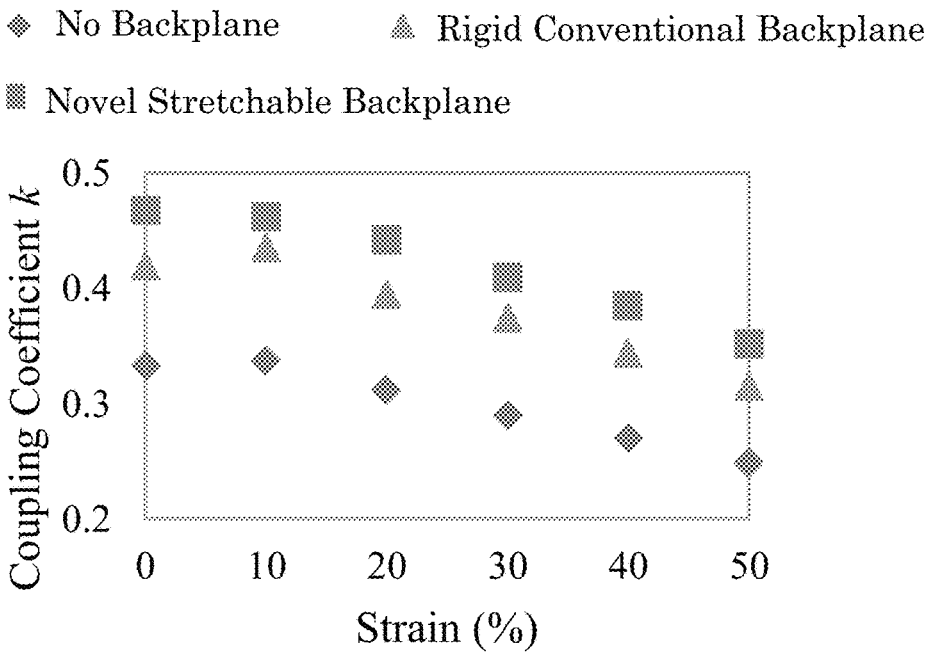
FIGS. 10A and 10B are plots showing magnetic coupling and the quality factor, respectively, for the novel deformable backplane of the wireless power transfer system along with data for no backplane present and a rigid conventional backplane for comparison.
Figure 10B:
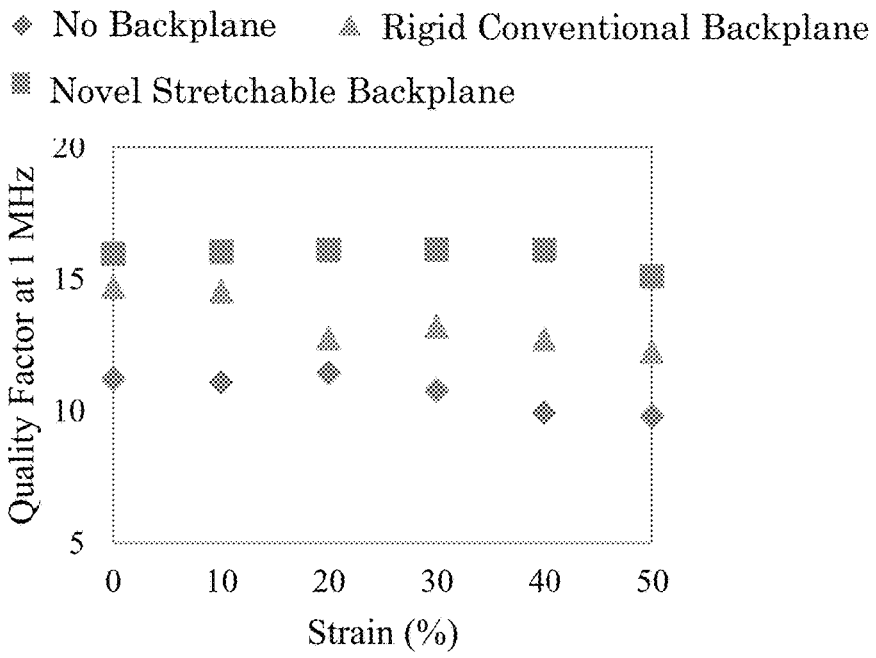

FIGS. 10A and 10B are plots showing magnetic coupling and the quality factor, respectively, for the novel deformable backplane 30A/ 30B of the wireless power transfer system 100. For comparison, data for no backplane present and a rigid conventional backplane is also shown.

Although deformable composites have relative permeability an order of magnitude or more lower than more conventional magnetic materials, the novel ferroelastomer backplane provides a significant improvement in coupling while maintaining the ability to stretch/compress and freely deform. With the ferroelastomer backplane, the coupling coefficient for a single turn inductor rose from 0.70 for a ferrite backplane only on the rigid side to 0.76 with a 2.5 mm thick ferroelastomer layer under the deformable coil. This corresponds to an improvement in the maximum power transfer efficiency, from 81% to 86%. For a multi-turn variant, a similar improvement was demonstrated, from 81% to 90% power transfer efficiency. As the plot of FIG. 10A illustrates, with the increased effective distance, the magnetic coupling drops with strain. The improvement in coupling due to the magnetic backplanes is maintained even with mechanical strain. This is despite a small reduction in permeability of the ferroelastomer (to approximately 2.4 at 50% uniaxial strain) during stretching due to the changes in particle spacing within the composite. In addition, as the plot of FIG. 10B shows, the quality factor of the stretchable inductor decreases during stretching by a maximum of 13% 17% and 7% for the no backplane, rigid only and both backplane cases respectively. As with the coupling coefficient, the improvement in the quality factor is also maintained as the inductor is stretched to 50% strain.

By creating deformable inductive device, this invention is intended to allow a wider range of uses such as power generation (such as deformable power conversion able to conform to an irregular or non-planar surface This could lead to other possibilities such as stretchable/compressible display systems, a helmet to efficiently use power from helmet-mounted solar cells, or a computer or communication system woven into a uniform.

Aspects related to this invention have been previously disclosed in the following publication: Nathan Lazarus, Chris D. Meyer, Sarah S. Bedair, Geoffrey A. Slipher, and Iain M. Kierzewski, "Magnetic Elastomers for Stretchable Inductors," *ACS Applied* Materials & *Interfaces* 2015, 7 (19), 10080-10084, which published May 6, 2015, herein incorporated by reference in its entirety.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present disclosure and its practical applications, to thereby enable others skilled in the art to best utilize the invention and various embodiments with various modifications as may be suited to the particular use contemplated.

While the foregoing is directed to embodiments of the present invention, other and further embodiments of the invention may be devised without departing from the basic scope thereof, and the scope thereof is determined by the claims that follow.

The invention claimed is:

1. A deformable inductive device comprising:

a magnetic core formed of an elastomer material having magnetic asymmetric, flat platelets dispersed there within, the platelets comprising no more than about 20% by weight of the magnetic core; and a deformable electrode embedded in, attached to, or in close proximity with the magnetic core, wherein both the magnetic core and the deformable electrode are configured so as to be readily elastic at greater than about ±5% strain and maintain operability of the device.

2. The device of claim 1, wherein the deformable inductive device is an inductor, solenoid, or transformer and the deformable electrode is at least partially embedded in the magnetic core.

3. The device of claim 1, wherein the deformable inductive device is part of a wireless power transfer system which comprising a coil and a magnetic backplane which is the magnetic core with the coil being attached to or in close proximity to the magnetic backplane.

4. The device of claim 1, wherein the elastomer material comprises a polymer or plastic material.

5. The device of claim 4, wherein the polymer comprises natural rubber or a silicone material.

6. The device of claim 1, wherein the magnetic particles are formed of iron, nickel, cobalt or an alloy thereof, or carbonyl iron.

7. The device of claim 1, wherein the magnetic platelets are formed of Sendust or molypermalloy.

8. The device of claim 7, wherein, the magnetic asymmetric the magnetic asymmetric, flat platelets have an average length of about 66 μm and a thickness of about 1 μm.

9. The device of claim 1, wherein the deformable electrode comprises at least one deformable conductive trace or at least one coil having one or more turns.

10. The device of claim 9, wherein the at least one deformable conductive trace is about 500 nm thick and 100 μm wide.

11. The device of claim 1, wherein the deformable electrode comprises at least one deformable channel containing a liquid conductor.

12. The device of claim 11, wherein the liquid conductor comprises a liquid metal, flowable elastomer or polymer having conductive particles intermixed therein, or a fluid solution containing an ionic conductor or electrolyte.

13. The device of claim 12, wherein the liquid metal comprises Galinstan, eutectic gallium/indium, or mercury.

14. The device of claim 1, wherein both the magnetic core and the deformable electrode are configured to be deformable from about −50% strain to about 100% strain and maintain operability of the device.

15. A method of forming the deformable inductive device of claim 1, comprising the steps of:

mixing the magnetic asymmetric, flat platelets in a liquefied form of the elastomer material of precursors thereof:

casting the mixture around, on, or close to the deformable electrode; and then allowing the mixture of solidify.

16. The method of claim 15, further comprising:

covering the deformable electrode, at least partially, with a first elastomer prior to casting the mixture.

17. A deformable inductive device comprising:

a magnetic core formed of ferroelastomer comprised of magnetic asymmetric, flat platelets dispersed there within, the platelets comprising no more than about 20% by weight of the magnetic core; and a deformable electrode, wherein both the magnetic core and the deformable electrode are configured so as to be readily elastic at greater than about ±5% strain and maintain operability of the device.

* * * * *